US007784977B2

(12) United States Patent
Moolman et al.

(10) Patent No.: US 7,784,977 B2
(45) Date of Patent: Aug. 31, 2010

(54) LAMP USING A LIGHT EMITTING DIODE (LED) AS A LIGHT SOURCE

(75) Inventors: Jacobus Philippus Moolman, Pretoria (ZA); Tymen Nagel, Pretoria (ZA)

(73) Assignee: HD Developments (Proprietary) Limited, Pretoria (ZA)

( * ) Notice: Subject to any disclaimer, the term of this patent is extended or adjusted under 35 U.S.C. 154(b) by 408 days.

(21) Appl. No.: 11/885,694

(22) PCT Filed: Feb. 27, 2006

(86) PCT No.: PCT/IB2006/000393

§ 371 (c)(1),
(2), (4) Date: Feb. 13, 2008

(87) PCT Pub. No.: WO2006/092697

PCT Pub. Date: Sep. 8, 2006

(65) Prior Publication Data

US 2010/0165633 A1 Jul. 1, 2010

(30) Foreign Application Priority Data

Mar. 1, 2005 (ZA) ..... 2005/01771

(51) Int. Cl.
*F21V 21/084* (2006.01)

(52) U.S. Cl. ..... 362/298; 362/105; 362/106

(58) Field of Classification Search ..... 362/105, 362/106, 183, 298, 302
See application file for complete search history.

(56) References Cited

U.S. PATENT DOCUMENTS

| | | | | |
|---|---|---|---|---|
| 3,796,886 | A | 3/1974 | Freeman | |
| 4,320,442 | A | 3/1982 | McCamy et al. | |
| 4,587,601 | A | 5/1986 | Collins et al. | |
| 5,647,664 | A | 7/1997 | Hanecka et al. | |
| 6,641,293 | B2 * | 11/2003 | Kumar et al. | 362/298 |
| 6,758,582 | B1 | 7/2004 | Hsiao et al. | |

FOREIGN PATENT DOCUMENTS

| | | |
|---|---|---|
| EP | 1182395 | 2/2002 |

* cited by examiner

*Primary Examiner*—David V Bruce
(74) *Attorney, Agent, or Firm*—Ladas and Parry LLP

(57) ABSTRACT

This invention relates to a lamp (80) using a light emitting diode (LED) (30) as a light source. The lamp includes a framework (12), and an LED holder (31) mounted on the framework for holding the LED. A primary reflector (34), having a primary reflecting surface (36) for reflecting at least a portion of light emitted by the LED, is mounted on the framework, being located in a path along which light is emitted by the LED. A secondary reflector (26) is also mounted on the framework, being located relative to the primary reflector such that light reflected by the primary reflector is reflected on to the secondary reflector. The secondary reflector has at least a secondary reflecting surface (28) which is shaped to reflect light reflected thereonto in a forward direction of he lamp and for focusing said light into a substantially focused beam. The invention extends to method of focusing light emitted by and LED.

13 Claims, 6 Drawing Sheets

LAMP USING A LIGHT EMITTING DIODE (LED) AS A LIGHT SOURCE

THIS INVENTION relates to a lamp using a light emitting diode (LED) as a light source. In particular, it relates to a method of focusing light emitted by a light emitting diode (LED). It relates also to a lamp.

The invention is expected to be particularly advantageously applicable to headlamps such as cap lamps used by miners in underground mines, and, accordingly, such application should particularly be borne in mind when considering this specification.

The term headlamp as used in this specification is to be understood as that part of a headlamp assembly which includes a light source of the assembly, and which is intended to be secured to the head of a user.

Reference D1 (U.S. Pat. No. 4,587,601) relates to a dual function light useable either as a spotlight or as a floodlight or, simultaneously, as both a spotlight and a floodlight. In one embodiment, it discloses a portable light including a first, rearwardly positioned, forwardly reflecting, reflector having a small, central, spherical portion and a surrounding parabolic portion. It includes also a second, forwardly positioned, rearwardly reflecting, concave spherical reflector, axially spaced in-front of the first reflector; and a small lamp placed on the focal point of the surrounding parabolic portion of the first reflector. Light rays emitted forwardly by the lamp are reflected by the second reflector onto the parabolic portion of the first reflector and reflected forwardly as a parallel array to form a spotlight.

Reference D2 (EP-A-1 182 395) relates to vehicle lighting equipment using an LED lamp. It includes a forwardly positioned, rearwardly reflecting, hyperbolic surface co-axially forward of the position of the LED; and a rearwardly positioned, forwardly reflecting, parabolic surface, co-axially rearward of the position of the LED. Light emitted forwardly by the LED is reflected by the fore reflector rearwardly onto the rear reflector which reflects it forwardly in a parallel array.

Reference D3 (U.S. Pat. No. 6,758,582) is very similar to D2, but uses an LED array as a light source.

References D4 (U.S. Pat. No. 3,796,886) and D5 (U.S. Pat. No. 5,647,664) are similar in some respects to D1, inter alia in that they disclose the light source to be on the focal point of the secondary or rear or forwardly reflecting reflector, which is parabolic or substantially parabolic.

In accordance with one aspect of the invention there is provided a method of focusing light emitted by a light emitting diode (LED), the method including reflecting at least a portion of the light emitted by the LED, such that the reflected light radiates away from a focal point, and, after the light has been reflected, focusing at least a portion of the reflected radiated light into a beam by again reflecting the light to direct it into the beam.

The reflecting and directing of said portion of the light emitted by the LED away from the focal point and into the beam may be effected by means of a pair of reflecting surfaces, one reflecting surface being a primary reflecting surface and the other reflecting surface being a secondary reflecting surface, each of the reflecting surfaces being shaped to have a focal point, and the reflecting surfaces being relatively aligned and spaced such that their focal points coincide to form said focal point away from which the reflected light radiates.

The term focal point as used in this specification is to be understood to be a small area, smaller than the area of the LED from which the light is emitted, away from which small area the light is radiated, the focal point preferably being as small as practicable.

The reflecting of said portion of the light emitted by the LED may be effected by the primary reflecting surface, and the method, simultaneously with said reflecting, including directing the light to radiate away from the focal point.

The focusing of said portion of the light after it radiates away from the focal point may be by means of the secondary reflecting surface.

The directing of said portion of the light emitted by the LED to radiate away from the focal point may be by passing it through the focal point, away from which it then radiates towards the secondary reflecting surface. Instead, the reflecting of said portion of the light emitted by the LED may include intercepting the light emitted by the LED before it reaches the focal point, and reflecting the intercepted light, the directing of said portion of the light so that it radiates away from the focal point, being by directing the intercepted light so that it radiates away from the focal point and towards the secondary reflecting surface. The said portion of the emitted light is thus reflected before it reaches the focal point, so that it does not pass through the focal point, but merely radiates away therefrom.

The focusing of the reflected radiated light into the beam may be such that the light in the beam is substantially collimated, i.e. the beam is substantially concentrated or focused.

The method may include reflecting a portion of the light emitted by the LED to form a peripheral light zone surrounding the beam. Typically, a minor portion of the light emitted by the LED is reflected to form said peripheral light zone, such that said peripheral light zone has a lower intensity than the beam which it surrounds.

The method may further include permitting a portion of the light emitted by the LED to be emitted without being reflected, said unreflected portion of the light forming part of the light beam. In some embodiments, at least part of said unreflected portion of the light may form part of the peripheral light zone.

In accordance with another aspect of the invention there is provided a lamp, the lamp having an operatively front end for facing in a forward direction, and the lamp including:

a framework;

a light emitting diode (LED) holder mounted on the framework for holding an LED;

a primary reflector mounted on the framework and located in a path along which light is emitted by an LED held by the holder, the primary reflector having a primary reflecting surface for reflecting at least a portion of the emitted light; and a secondary reflector mounted on the framework and located relative to the primary reflector such that light reflected by the primary reflector, in use, is reflected on to the secondary reflector, the secondary reflector having a secondary reflecting surface, and the secondary reflecting surface being shaped for reflecting light reflected thereonto in the forward direction of the lamp and for focusing said light into a substantially focused beam.

The LED holder may be positioned relative to the framework such that an LED held thereby in use is directed for emitting light in the general forward direction of the lamp, the primary reflector being located in front of the LED holder such that the primary reflecting surface generally faces in a rearward direction of the lamp, for reflecting said portion of the light emitted in use by the LED in a general rearward direction of the lamp, and the secondary reflector being located behind the primary reflector such that the secondary reflecting surface generally faces in the forward direction of the lamp, the secondary reflector being shaped generally to cup an LED held by the LED holder, and the primary reflector being smaller than the secondary reflector, to permit passing therearound, in the forward direction of the lamp, of the substantially focused light beam reflected by the secondary reflecting surface.

The lamp may have a central optical axis extending in the fore-and-aft directions of the lamp, the LED holder being located such that an LED held thereby in use is located on the central optical axis, and the primary reflecting surface and the secondary reflecting surface being co-axial about the central optical axis.

The primary reflector and the secondary reflector may be shaped such that the primary and the secondary reflecting surfaces have generally dome-shaped profiles, each of the primary reflecting surface and the secondary reflecting surface having a focal point, and the primary reflector and the secondary reflector being relatively spaced such that the focal points of the primary reflecting surface and the secondary reflecting surface coincide, being located on the central optical axis.

The primary reflecting surface may have a concavely domed profile, facing in the rearward direction of the lamp towards the secondary reflector and the LED holder, the primary reflector and the secondary reflector being relatively spaced such that the focal points of the primary and the secondary reflecting surfaces are located between the primary and the secondary reflecting surfaces and in front of an LED held by the LED holder.

The primary reflector may be provided with a circular opening co-axial with and concentric about the central optical axis, for permitting a portion of the light emitted by an LED held by the LED holder to be emitted, without being reflected by the primary reflector, in the forward direction of the lamp, for forming part of said substantially focused beam. In some embodiments, the opening of the primary reflector may be sufficiently big such that a portion of the unreflected light forms part of the peripheral light zone surrounding the beam.

The light emitted by an LED held by the LED holder may be generally in the form of a cone of light. Thus, in use, by virtue of the particular construction of the primary and secondary reflectors, the substantially focused beam will be of relatively high intensity, and the peripheral light zone surrounding the beam will be of relatively low intensity.

The secondary reflector may be provided with a secondary reflector opening co-axial with and concentric about the central optical axis, and in which opening the LED holder is received, such that, in use, an LED held by the holder projects through the secondary reflector opening towards the front end of the lamp.

The secondary reflector may also have at least one tertiary reflecting surface, each tertiary reflecting surface being concentric about the central optical axis and having a generally convex profile, for reflecting a portion of the light emitted by an LED held by the LED holder generally in the forward direction of the lamp for forming a peripheral light zone surrounding said substantially focused beam. Naturally, each tertiary reflecting surface faces generally in the forward direction of the lamp, for directing reflected light in the generally forward direction of the lamp.

Advantageously, the secondary reflector may have two tertiary reflecting surfaces, one tertiary reflecting surface framing the secondary reflector opening and the other tertiary reflecting surface framing the secondary reflecting surface, such that the secondary reflecting surface is located radially between the two tertiary reflecting surfaces.

The lamp may also include a transparent shield, typically a circular shield, located at the front end of the lamp in front of the LED holder and the secondary reflector, and through which shield light is emitted, in use, in the forward direction of the lamp, the shield having an inner face which faces the LED holder and the secondary reflector, and an outer face which faces away from the LED holder and the secondary reflector.

The primary reflector may be mounted on the shield, being located on the inner face of the shield. Instead, the primary reflector may be integrally formed with the shield, being located on the inner face of the shield.

The inner and outer faces of the shield may be flat. Instead, either or both of these faces may be curved, to assist in producing a well-focused beam of light.

The lamp may further include a casing providing the framework of the lamp, the casing having a front end providing the front end of the lamp, and the casing defining a cavity opening towards the front end of the lamp and in which cavity the LED holder, the primary reflector and the secondary reflector are housed, the shield closing the opening of the cavity.

The lamp may also include at least one seal for sealing off the interior of the cavity of the casing from the surroundings of the casing.

The lamp may be in the form of a headlamp for securing to the head of a user, the framework of the lamp being provided with a securing formation for securing the headlamp to the head of a user.

In a particular embodiment, the lamp is in the form of a cap lamp for securing to a safety cap for a miner, the lamp being secured to the head of a user via the safety cap.

The lamp may yet further include an LED, the LED being held by the LED holder.

In accordance with a further aspect of the invention there is provided a lamp assembly, the lamp assembly including a lamp as hereinbefore described having an LED holder, and a battery operatively connected to the lamp for energizing an LED held by the holder.

The assembly may be a headlamp assembly, which assembly includes an LED held by the LED holder.

Naturally, the headlamp assembly may also include a switch operatively connected to the battery and to the LED holder, for switching power to the LED on and off.

The battery may be a rechargeable battery, for example a lithium-based battery.

In accordance with yet another aspect of the invention there is provided a kit for a lamp, the kit including a primary reflector and a secondary reflector, the primary reflector and the secondary reflector being as hereinbefore described with reference to the lamp.

The kit may further include an LED holder for holding an LED, the holder being as hereinbefore described with reference to the lamp.

The kit may also include a shield, the shield being as hereinbefore described with reference to the lamp, with the primary reflector, optionally, being mounted on, or being integrally formed with the shield.

The kit may still further include at least one ring-shaped seal for receipt around the secondary reflector.

If desired, the kit may also include a diffuser or similar suitable light-scattering device for diffusing or scattering light emitted by an LED in use.

Although the lamp in accordance with the invention is primarily described in this specification as being a headlamp, it is to be appreciated that the lamp can equally advantageously be used in the context of flashlights or torches, or the like.

The invention is now described, by way of non-limiting example, with reference to the accompanying diagrammatic drawings.

Figure 1:
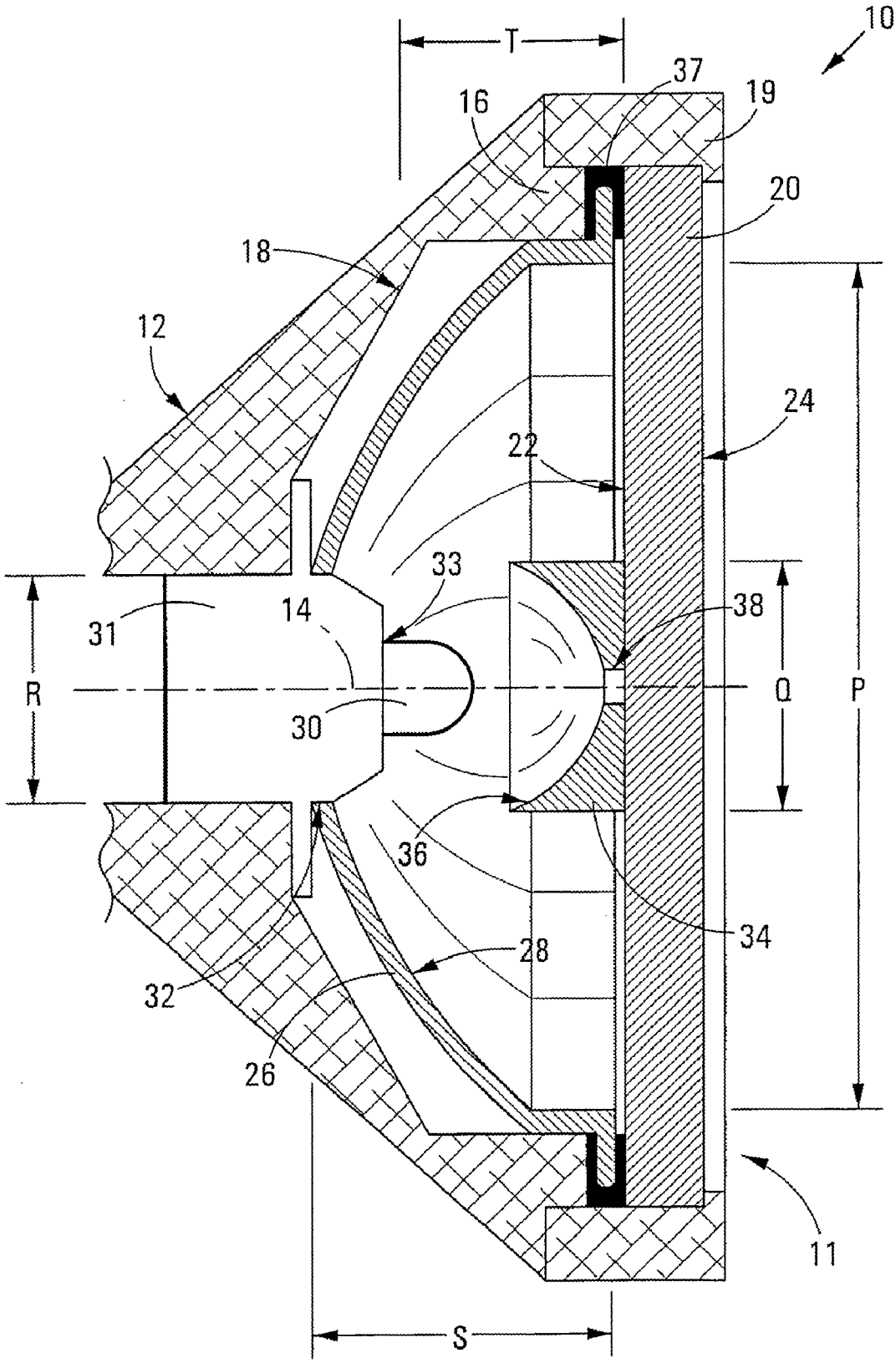
FIG. 1 shows, schematically, in part, an axial sectional view of a lamp in accordance with the invention.

With reference to FIG. 1 of the drawings, a lamp in accordance with the invention is generally designated by reference numeral 10. The lamp 10, in this example, is in the form of a headlamp, more particularly, it is in the form of a cap lamp for securing to a safety helmet used in underground mines. For ease of reference, the lamp 10 is hereinafter referred to as the headlamp 10.

The headlamp 10 has an operatively front end 11, and includes a casing or shell 12 (shown, partially, in concept in FIG. 1) having a central optical axis 14 extending in the fore-and-aft direction of the headlamp 10 and of the casing 12. The casing 12 is of two-part construction, comprising a wall 16 (shown in part only in FIG. 1) defining a cavity 18 in the casing 12, the cavity 18 opening in the forward direction of the headlamp 10, and a closure ring 19 received over a front end of the wall 16. The casing 12 is a conventional headlamp casing or shell and, accordingly, is not further described. The headlamp 10 further includes a transparent safety glass shield 20. The shield 20 closes off the cavity 18, and is retained in position by means of the aforementioned closure ring 19. The shield 20 has an inner face 22 facing into the cavity 18, and an outer face 24 facing away, in a forward direction of the headlamp 10, from the cavity 18.

The headlamp 10 further includes a generally cup-shaped or concavely dome-shaped secondary reflector 26 provided with a concave elliptically-profiled secondary reflecting surface 28 facing in the forward direction of the headlamp 10. The secondary reflector 26 is removably mounted on the casing 12 in the cavity 18, removable by releasing the closure ring 19 from the wall 16 and then removing the shield 20. A light emitting diode (LED) 30, having a base 33, is mounted on the casing 12 in the cavity 18, the LED 30 being mounted on the casing 12 via an aluminium LED holder 31 mounted, at a rear end of the cavity 18, on the casing 12 and received in a central opening 32 provided in the secondary reflector 26, the LED 30 thus being held by the holder 31. The base 33 of the LED 30 has a centre located on the central optical axis 14.

The headlamp 10 further includes a primary reflector 34 mounted on the shield 20 and located on the inner surface 22 thereof. The primary reflector 34 is thus located in the cavity 18. Further, the primary reflector 34 is provided with a concave elliptically-profiled primary reflecting surface 36, and is oriented such that the reflecting surface 36 is directed in the rearward direction of the headlamp 10 and faces the LED 30 and the secondary reflecting surface 28. The primary reflector 34 is provided with a central opening 38, the purpose of which is described hereinafter.

Both the primary reflector 34 and the secondary reflector 26 are in the form of synthetic plastics castings or mouldings, their respective reflecting surfaces 28, 36 being provided by reflective chrome coatings provided on the castings or mouldings. Naturally, in other examples, the coatings can be any other suitably reflective coatings, for example aluminium coatings. In the drawings, the reflective coating are shown as respectively being applied to the forwardly directed face of the secondary reflector 26 and to the rearwardly directed face of the primary reflector 34. In other embodiments (not shown), the reflectors 26, 34 can be constructed of a translucent material, for example synthetic plastics or glass, in which case the aforementioned reflective coatings can be applied respectively to a rearwardly directed, or external, face of the secondary reflector 26, and to a forwardly directed, or external, face of the primary reflector 34, the primary reflector 34 being of shell-like construction such that said forwardly directed, or external, face thereof has a profile corresponding to the primary reflecting surface 36 of the lamp herein described. Thus, in use, light rays pass through the translucent parts of the reflectors 26, 34 before and after reflection thereof.

As can be seen in FIG. 1 of the drawings, the LED holder 31 and the LED 30 are located on the central optical axis 14, and both the secondary reflecting surface 28 and the primary reflecting surface 36 are concentric about the central optical axis 14.

More particularly, the secondary reflecting surface 28 surrounds and cups the LED 30, and the primary reflecting surface 36 is located in front of the LED 30.

The headlamp 10 further includes a ring-shaped seal 37 providing sealing between the wall 16 and the closure ring 19 of the casing 12, and the inner face 22 of the shield 20. The seal 37 thus seals off the interior of the headlamp 10 from its surroundings.

Figure 2:
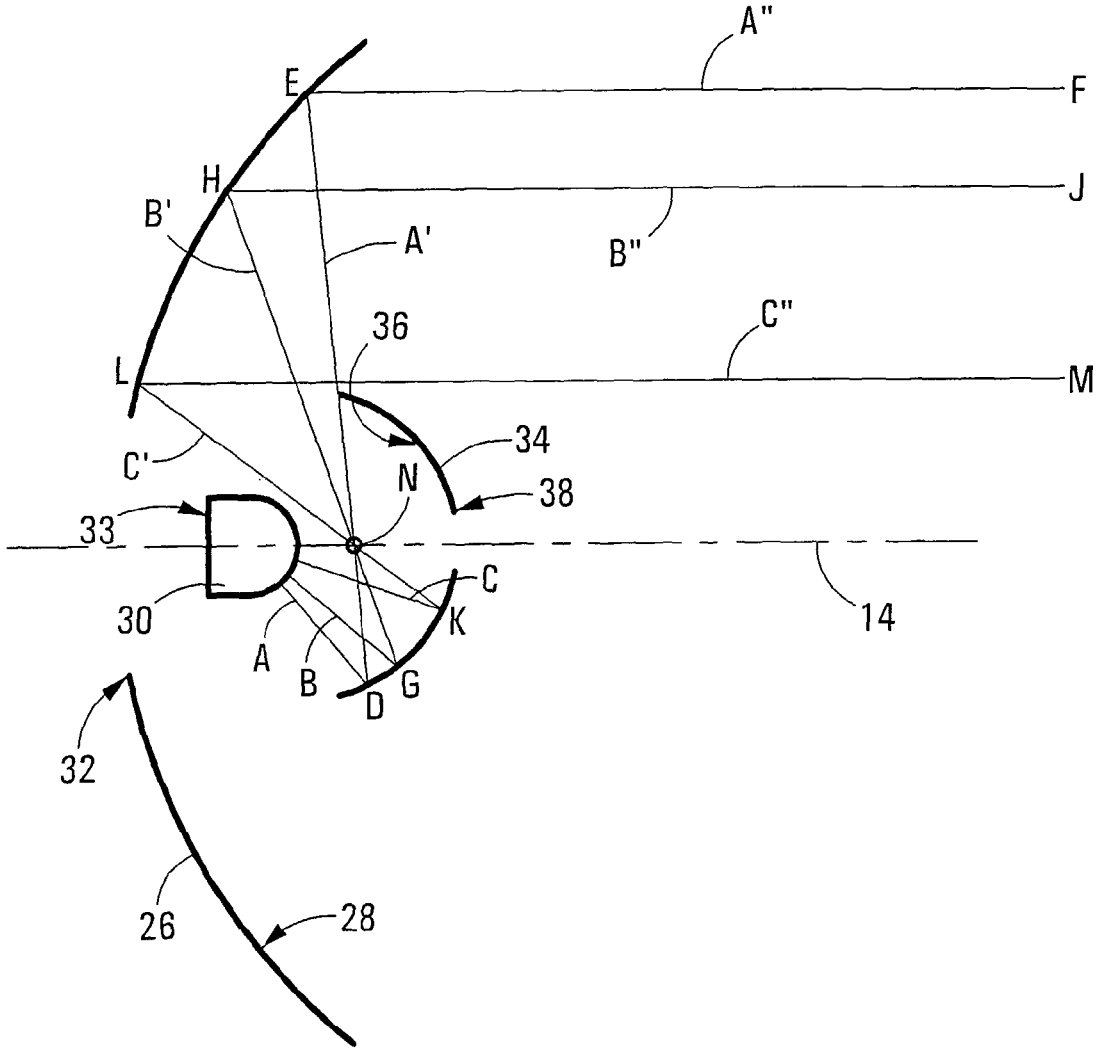
FIG. 2 shows, schematically, a line diagram illustrating operation of the lamp shown in FIG. 1.

FIG. 2 of the drawings illustrates optical operation of the headlamp 10, and shows, partially and in concept, a line diagram of the secondary reflecting surface 28, the LED 30 and the primary reflecting surface 36. Notional light rays, described in detail hereinafter, emitted by the LED 30, are also indicated in FIG. 2.

When the LED 30 is energized, it emits light in a generally forward direction of the headlamp 10. By virtue of the nature of an LED, the emitted light is generally in the form of a cone of light. For illustrative purposes, three notional light rays are shown in FIG. 2, the light rays respectively being numbered A, B and C. Although not indicated, a portion of the light emitted by the LED 30 passes through the central opening 38 in the primary reflector 34 and through the shield 20 (not shown in FIG. 2). The light rays A, B and C impinge on the primary reflecting surface 36, and are reflected, through a focal point N (which is the common focal point of both the primary reflecting surface 36 and the secondary reflecting surface 28), back towards the secondary reflecting surface 28. The reflecting surfaces 28, 36 are thus shaped such that each of them has a focal point, the reflectors 26, 34 being relatively spaced such that, as foreshadowed above, the focal points of the reflecting surfaces 28, 36 coincide, being located on the aforementioned point N and on the central optical axis 14. The reflected parts of the rays A, B and C are respectively numbered A', B' and C'. The reflected parts A', B' and C' are then reflected and directed, by means of the secondary reflecting surface 28, in the forward direction of the headlamp 10 and through the shield 20, said reflected and directed parts of the light rays respectively being numbered A", B" and C". By virtue of the rays A', B' and C' passing more or less through the focal point N, as will become more apparent hereinafter, the rays A", B" and C" are thus more or less collimated, being more or less parallel to the central optical axis 14.

In particular, the emitted light ray A is projected on to the primary reflecting surface 36 at a position D on the primary reflecting surface 36, from where, as indicated by the line A', it is reflected, through the focal point N, back to a position E on the secondary reflecting surface 28. The secondary reflecting surface 28, as indicated by the line A", then reflects and directs the ray A towards a position F in front of the headlamp 10. The light ray B, in turn, is projected, at a smaller angle relative to the central optical axis 14 than the light ray A, on to the primary reflecting surface 36 at a position G, from where it is reflected through the focal point N, as indicated by the line B', back towards the secondary reflecting surface 28 to a position H. The secondary reflecting surface 28 then reflects and directs the light ray B, as indicated by the line B", towards a position J in front of the headlamp 10. The ray C, in turn, is projected, at a relatively smaller angle to the central optical axis 14 than the ray B, on to the primary reflecting surface 36 at a position K, from where it is reflected, through the focal point N, as indicated by the line C', on to the secondary reflecting surface 28 at a position L. The secondary reflecting surface 28 then, as indicated by the line C", reflects and directs the light ray C to a position M in front of the headlamp 10.

As can be seen in FIG. 2, and as described, the reflected portions A', B' and C' of the rays go more or less through the focal point N, which focal point is located between the primary reflecting surface 36 and the LED 30. The focal point N is located in front of the LED 30. The reflected light, as it passes through the focal point N thus forms, at the point N, a single notional point light source which emits light onto the secondary reflecting surface 28.

Thus, with the particular construction and relative positioning of the secondary reflecting surface 28, and of the LED 30 and the primary reflecting surface 36, a more or less concentrated or focused (collimated) light beam is emitted from the headlamp 10, in the forward direction of the headlamp 10, as notionally indicated by lines A", B" and C".

The size of the primary reflector 34 and the spacing thereof from the LED 30 is such that a relatively small portion, as opposed to the portion of the emitted light reflected by the primary reflecting surface 36, of light emitted by the LED 30 passes around the primary reflector 34, i.e. without being reflected by the primary reflecting surface 36. Said relatively small portion of light is thus emitted in the forward direction of the headlamp 10 at a relatively wide angle relative to the central optical axis 14, to form a peripheral light zone of relatively low intensity light surrounding the concentrated or focused light beam. If desired, the headlamp 10 can also include a diffuser lens (not shown) mounted on the shield 20 in front of the central opening 38 of the primary reflector 34, for diffusing the portion of emitted light passing through the central opening 38. The diffusing lens will be constructed and oriented such that said portion of light passing through the opening 38 will be diffused, so that at least part of said diffused portion forms part of the aforementioned peripheral light zone surrounding the concentrated or focused light beam.

As mentioned, the cross-sectional profiles of both the secondary reflecting surface 28 and the primary reflecting surface 36 have generally elliptic cross-sectional profiles, so that both the primary reflecting surface 36 and the secondary reflecting surface 28 share the abovementioned focal point N.

In this example, without being bound by theory, the elliptic cross-sectional profiles of the secondary reflecting surface 28 and of the primary reflecting surface 36, relative to the vertex of the specific surface, can be described by the equation:

$$z = \frac{y^2/(Rad)}{1+\sqrt{1-(1+cc)(y/Rad)^2}}$$

wherein:

y is the radial distance from the central optical axis 14 and passing through the centre of the base 33 of the LED 30;

z is the axial distance parallel to the central optical axis 14 from the plane containing the vertex of the specific surface;

Rad is the nominal radius of the reflecting surface in mm, and in the present example has a value of −6.4 mm for the primary reflecting surface 36, and a value of 24.1 mm for the secondary reflecting surface 28; and cc is a conical constant, and in the present example has a value of −0.28 for the primary reflecting surface 36, and a value of −0.77 for the secondary reflecting surface 28.

Furthermore, in this example, the secondary reflecting surface 28 has, at its rim, a diameter P of 45 mm, and the primary reflecting surface 36 has a diameter Q of 13.6 mm. The opening 32 in the secondary reflector 26, in this example, has a diameter R of 12 mm, and the central opening 38 of the primary reflector 34 has a diameter of 2 mm. In this example, the shield 20 has a thickness of 4 mm, and a distance S between the base of the secondary reflecting surface 28 and the base of the primary reflecting surface 36 is 15.5 mm, with the base 33 of the LED 30 being spaced a distance T of 12.8 mm from the inner face 22 of the shield 20, and 3.7 mm from the base of the secondary reflecting surface 28.

The LED 30, in this example, is an LXHL-PW01 LED.

Figure 3:
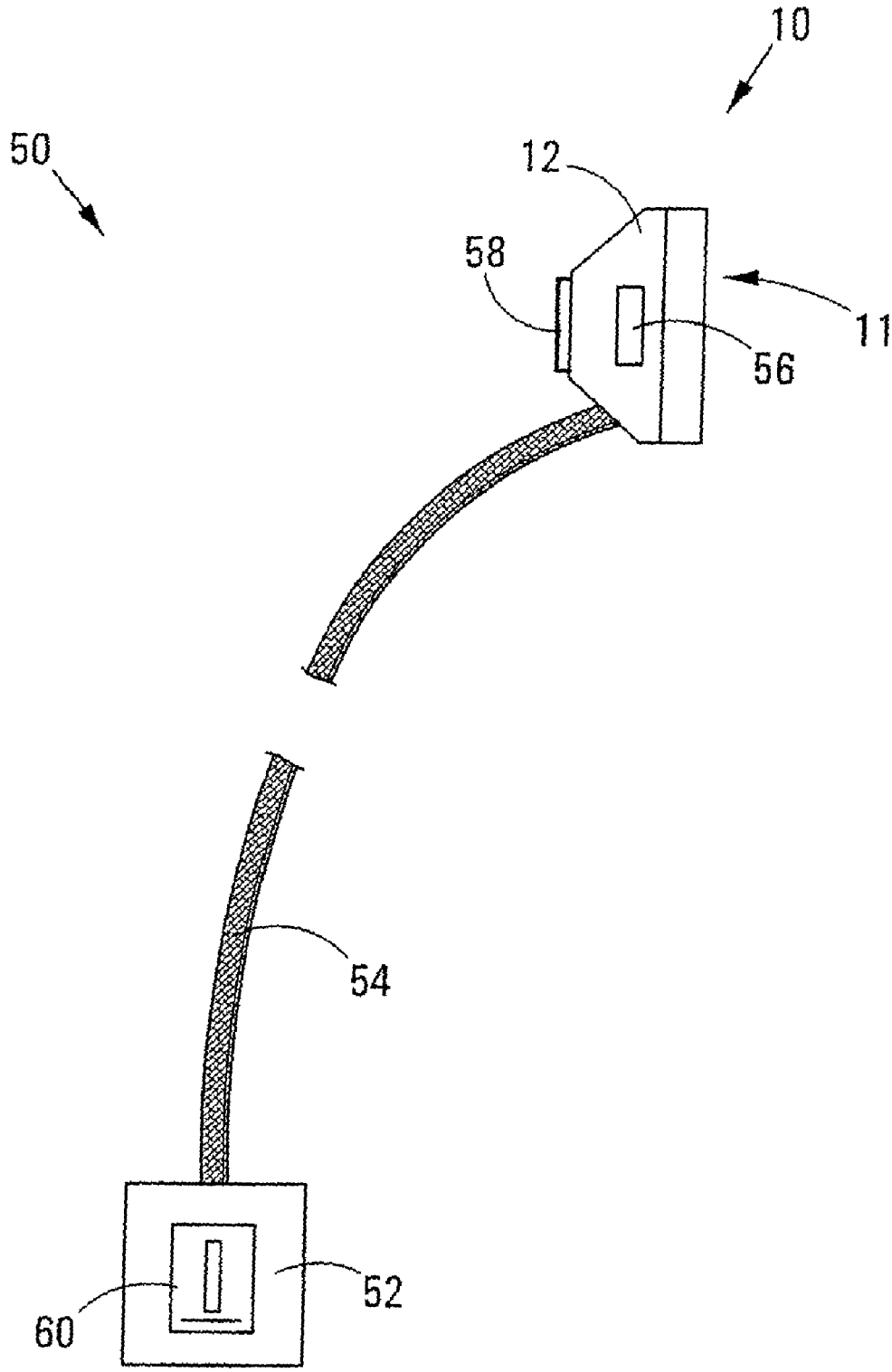
FIG. 3 shows, schematically, a headlamp assembly including a lamp in accordance with the invention.

Referring now to FIG. 3 of the drawings, a headlamp assembly in accordance with the invention is generally designated by reference numeral 50. When used in the context of underground mines, the headlamp assembly 50 is thus in the form of a cap lamp assembly. The headlamp assembly 50 includes a headlamp 10 as hereinbefore described, and a rechargeable lithium-based battery 52 (shown in concept only) for energizing the LED 30 of the headlamp 10. An electrical cable 54 connects the battery to the LED 30. Furthermore, as is conventional in headlamp or cap lamp technology, the headlamp assembly 50 also includes a switch 56 (shown in concept only) for switching electrical power from the battery 52 to the LED 30 on and off. Furthermore, the casing 12 of the headlamp 10 is provided with a conventional securing formation 58 (shown in concept only) for securing the headlamp 10, in the context of underground mining, to a safety helmet (not shown).

The battery 52 is provided with a clip or hook 60 (shown in concept only) by means of which it can be clipped or hooked on to a belt or harness (not shown) of a user of the headlamp assembly 50.

By way of development, the battery 52 can be incorporated in the headlamp 10, being mounted on the casing 12, either in the cavity 18, or outside the cavity 18. Instead, the battery 52 can be mounted on a miner's cap to which the headlamp 10 is to be secured in use, or could even be incorporated in such a cap. In such cases, as will be appreciated, the cable 54 can be replaced with another electrically conductive lead or contact.

Figure 4:
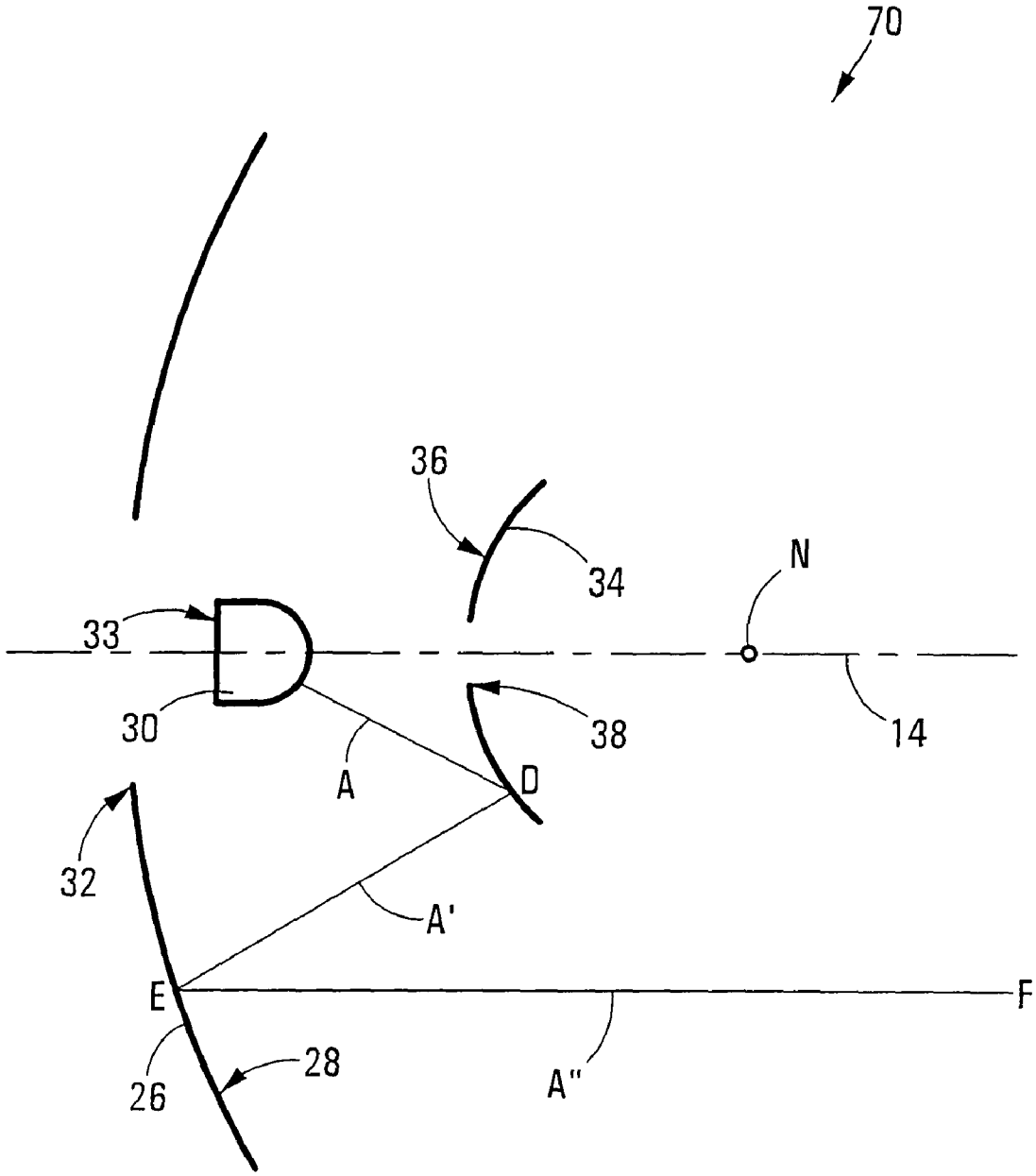
FIG. 4 shows, schematically, a line diagram illustrating operation of another embodiment of a lamp not in accordance with the invention.

FIG. 4 of the drawings illustrates optical operation of another embodiment of a lamp not in accordance with the invention, and shows, partially and in concept, a line diagram of a secondary reflecting surface, also being indicated by reference numeral 28, an LED, also being indicated by reference numeral 30, and a primary reflecting surface, also being indicated by reference numeral 36, of said other embodiment of the lamp. Those parts of the lamp shown in FIG. 4 are generally designated by reference numeral 70, and for ease of reference said other embodiment of the lamp is hereinafter referred to as the lamp 70. A notional light ray emitted by the LED 30, is also indicated in FIG. 4, the light ray being designated by A, and being described in more detail hereinafter.

The primary reflector 34 of the lamp 70 has a convexly domed profile, being oriented such that its primary reflecting surface 36, which, in this example, has an elliptic cross-sectional profile, faces towards the rear of the lamp 70, i.e. towards the LED 30 and the secondary reflector 26. Further, the curvature of the secondary reflector 26 and the spacing of the primary reflector 34 relative to the secondary reflector 26 is such that the common focal point, also designated N, of the reflecting surfaces 28, 36 is located in front of the primary reflector 34, i.e. towards the other side of the primary reflector 34 than the LED 30 and the secondary reflector 26.

In this embodiment, the light emitted by the LED 30 is thus intercepted by the primary reflector 34 before it reaches the common focal point N. The light ray A, emitted by the LED 30, thus impinges on the primary reflecting surface 36 before it reaches the focal point N, at point D on the primary reflecting surface 36. The primary reflecting surface 36 reflects the light ray A towards a point E on the secondary reflecting surface 28, said reflected part of the light ray A being indicated by A'. By virtue of the particular curvatures of the two reflectors 26, 34 and their relative spacing, the part A' of the light ray A radiates away from the focal point N, without passing through the focal point N, towards the point E on the secondary reflecting surface 28. The light ray A, i.e. that part indicated by A', is then reflected by the secondary reflecting surface 28 towards a point F in front of the lamp 70, said part of the reflected light ray A being designated by A". As can be seen, the light ray A, when it leaves the lamp 70, i.e. the part A", is more or less parallel to the central optical axis 14.

Apart from the aforedescribed differences between the headlamp 10 and the lamp 70, the lamp 70 is constructed and operates similarly to the headlamp 10 and, accordingly, the lamp 70 is not described further.

Figure 5:
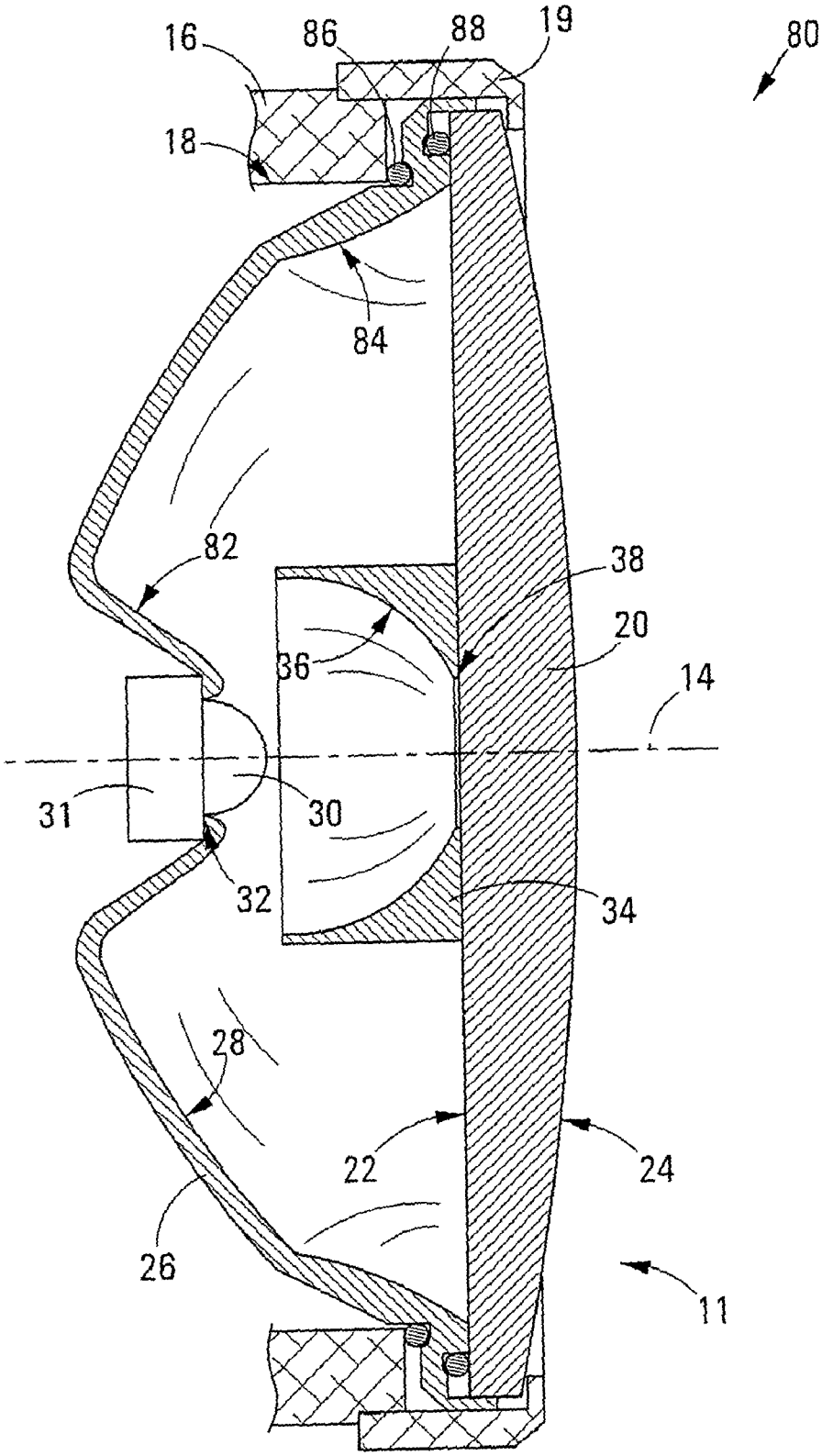
FIG. 5 shows, schematically, in part, an axial sectional view of a further embodiment of a lamp in accordance with the invention.

FIG. 5 shows yet a further embodiment of a lamp in accordance with the invention, the lamp shown in this figure being generally designated by reference numeral 80. The lamp 80 is also in the form of a headlamp. The lamp 80 in certain respects resembles the headlamp 10 and, accordingly unless otherwise indicated, reference numerals used to indicate parts or features of the headlamp 10 are used to indicate like parts or features of the lamp 80.

In the example shown in FIG. 5 (with reference to the above equation describing the cross-sectional profiles of the reflectors 26, 34), Rad has a value of −7.439 mm for the primary reflecting surface 36, and a value of 22.333 mm for the secondary reflecting surface 28. The conical constant cc in the present example has a value of −0.171 for the primary reflecting surface 36, and a value of −0.973 for the secondary reflecting surface 28.

The secondary reflector 26 of the lamp 80 is shaped to include or define, in addition to the secondary reflecting surface 28, also first and second tertiary reflecting surfaces which are respectively indicated by reference numerals 82 and 84. The first tertiary reflecting surface 82 frames the central opening 32 of the secondary reflector 26, and the second tertiary reflecting surface 84 frames the secondary reflecting surface 28. The secondary reflecting surface 28 is thus located radially between the first and second tertiary reflecting surfaces 82, 84.

The tertiary reflecting surface 82 has a convexly domed or roughly conically-shaped profile, and the tertiary reflecting surface 84 has a convexly domed profile and both of them, like the secondary reflecting surface 28, are concentric about the central optical axis 14.

In this embodiment, the lamp 80 includes two seals for sealing off the cavity 18 from the surroundings of the lamp 80. One of these seals being in the form of an O-ring 86 located between a front end of the wall 16 and the secondary reflector 26, the secondary reflector 26 being provided with a recess within which the O-ring 86 is seated. The other seal is also in the form of an O-ring, being designated by reference numeral 88, seated in a peripheral recess provided by the secondary reflector 26, the O-ring 88 being located and held captive between the reflector 26 and the inner face 22 of the shield 20.

In this embodiment, the outer face 24 of the shield 20 is slightly convexly shaped, to assist with focusing of the light emitted by the LED 30.

Further, in this embodiment, the opening 38 of the primary reflector 34 is somewhat greater in diameter than that of the primary reflector 34 of the headlamp 10. The primary reflector 34 of the lamp 80 also differs from the primary reflector 34 of the headlamp 10 in that it is shaped such that an operatively rear part of the primary reflecting surface 36, i.e. that part of the reflecting surface 36 closest to the LED 30, is circular conical, near cylindrical.

With the exception of the aforementioned differences, the construction of the lamp 80 is more or less similar to that of the headlamp 10 and, accordingly, the construction of the lamp 80 is not described in further detail.

Figure 6:
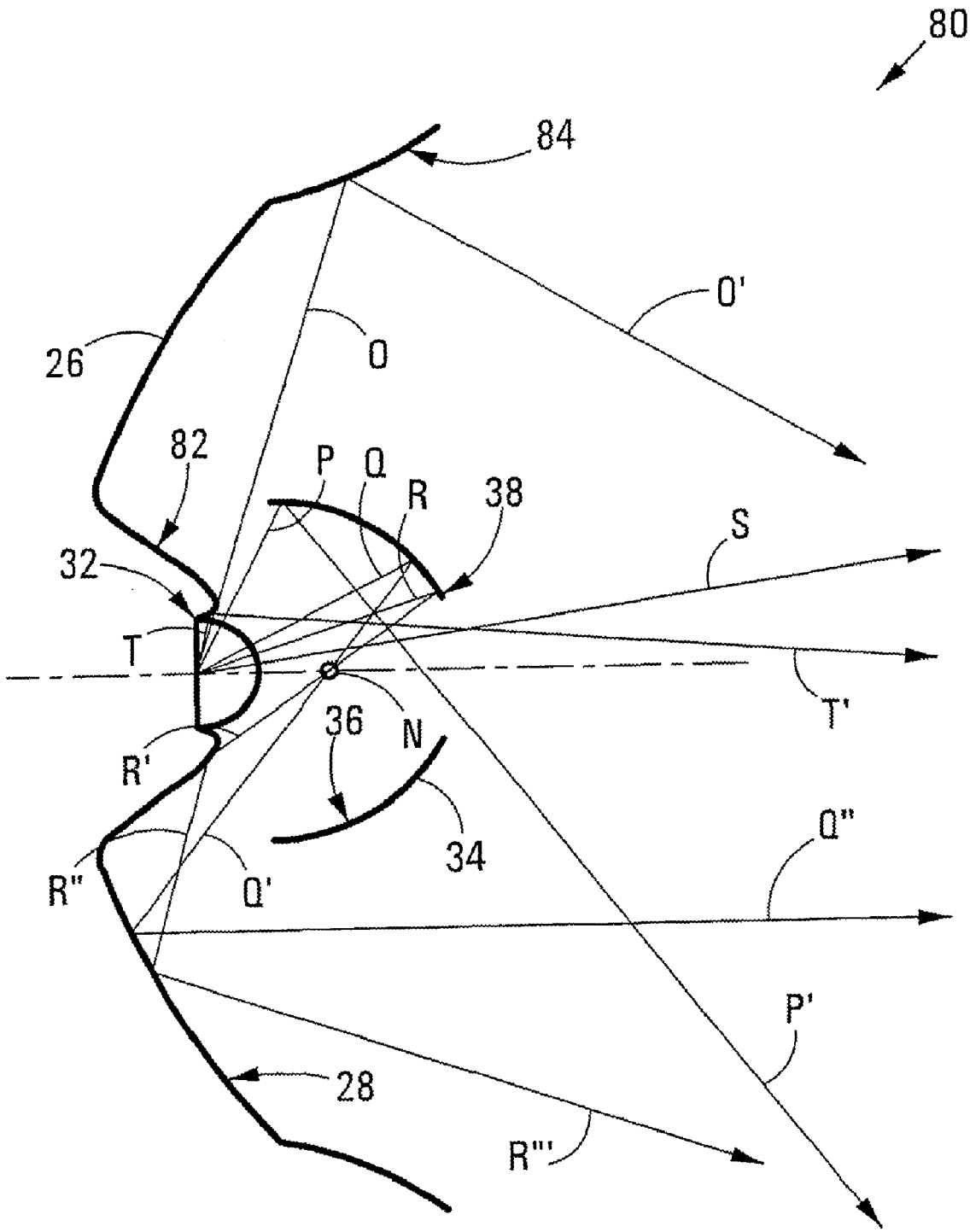
FIG. 6 shows, schematically, a line diagram illustrating operation of the lamp shown in FIG. 5.

FIG. 6 of the drawings illustrates optical operation of the lamp 80, and shows, partially and in concept, a line diagram of the secondary reflecting surface 28, the LED 30 and the primary reflective surface 36 of the lamp 80. Notional light rays, described in detail hereinafter, emitted by the LED, are also indicated in FIG. 6.

For illustrative purposes, six notional light rays are shown in FIG. 6, the light rays respectively being numbered O, P, Q, R, S and T. Although not indicated as such, it will be appreciated that a portion of the light emitted by the LED 30 passes, along the central optical axis 14, through the central opening 38 of the primary reflector 34 in a forward direction of the lamp 80, to form part of the concentrated or focused light beam provided by the lamp 80 in use.

The light ray O is emitted at a relatively wide angle from the LED 30, so that it impinges on the second tertiary reflecting surface 84 from where it is reflected across the central optical axis 14, said part of the reflected ray O being designated by O', to form part of a peripheral light zone surrounding the concentrated or focused light beam of the lamp 80. The light ray P is emitted from the LED 30 at a relatively smaller angle, relative to the central optical axis 14, than the light ray O and impinges on the aforedescribed circular conical, near cylindrical rear part of the primary reflecting surface 36, from where it is reflected through the central opening 38 of the primary reflector 34, the reflected part of the light ray P being indicated by P'. Thus, the reflected part P' of the light ray P forms part of the aforementioned peripheral light zone. The light ray Q is emitted from the LED 30 at a relatively smaller angle, relative to the central optical axis 14, than the light ray P, and impinges on the dome-profiled part of the primary reflecting surface 36 from where it is reflected, as indicated by Q', rearwardly onto the secondary reflecting surface 28, passing through the common focal point N. The part Q' of the light ray Q is then reflected by the secondary reflecting surface 28 in a forward direction of the lamp, parallel to the central optical axis 14. Said part of the light ray Q reflected by the secondary reflecting surface 28 is designated by Q", and forms part of the aforementioned concentrated or focused light beam of the lamp 80. The light ray R is emitted by the LED 30 at a smaller angle, relative to the central optical axis 14, than the light ray Q and impinges on the primary reflecting surface 36 at a position closely spaced from the central opening 38 of the primary reflector 34. A part of the light ray R which is reflected by the primary reflecting surface 34 is designated by R' and is reflected back towards the first tertiary reflecting surface 82, from where it is reflected, as indicated by R" onto the secondary reflecting surface 28. The secondary reflecting surface 28 reflects the light ray R at a relatively wide angle, relative to the central optical axis 14, in the forward direction of the lamp 80, said reflected part of the ray being designated by R'". The light ray R thus, after the aforedescribed reflecting thereof, thus also forms part of the peripheral light zone. The light ray S, in turn, is emitted by the LED 30 at a sufficiently small angle relative to the central optical axis 14, such that it passes through the central opening 38 of the primary reflector 34 without being reflected. The light ray S thus also forms part of the aforementioned peripheral light zone. Finally, the light ray T is reflected at a wider angle relative to the central optical axis 14 than the light ray O, the angle being such that the light ray T impinges on the first tertiary reflecting surface 82 in close proximity to the opening 32 of the secondary reflector 26. The first tertiary reflecting surface 82 then reflects the light ray T in the forward direction of the lamp 80, said reflected portion of the light ray T being designated by T'. The angle of the reflected light ray T', relative to the central optical axis 14, is such that the light ray T' passes, without being reflected, through the central opening 38 of the primary reflector 34, so that it crosses the central optical axis 14, to form part of the peripheral light zone. Naturally, the aforementioned reflecting of each of the notional light rays is, by virtue of the shape and relative positioning of the reflective surfaces, coupled with simultaneous direction of the rays, to achieve the beam and the surrounding peripheral light zone.

Because of the particular construction and the relative spacing of the reflectors 26, 34, most of the light emitted by the LED 30 impinges on the dome-profiled part of the primary reflecting surface 36 and follows more or less the same path as the light ray Q, i.e. passing through the focal point N, to form the concentrated or focused light beam. Thus, the concentrated or focused light beam will be a relatively high intensity light beam, relative to the peripheral light zone surrounding it, which peripheral zone is of relatively low intensity.

The light rays S and T, because of the angles, relative to the central optical axis 14, at which they leave the front end of the lamp 80, form a medium density peripheral zone surrounding the concentrated or focused light beam. In turn, the light rays O, P and R, also because of the angles, relative to the central optical axis 14, at which they leave the front end of the lamp 80, provide a relatively low intensity peripheral zone surrounding the aforementioned medium intensity light zone.

The invention as described and illustrated thus provides a headlamp which employs an LED as a light source, and emits a more or less concentrated or focused light beam of relatively high intensity, and a peripheral light beam or zone, surrounding the concentrated or focused light beam, of relatively lower intensity.

The invention has the advantage that, because of the relatively efficient way in which the light emitted by the LED is concentrated or focused, the battery of the head lamp assembly as described and illustrated can be smaller and, accordingly, lighter than batteries used to energize light sources of headlamps employing less efficient optical arrangements, without adversely affecting the intervals between recharging of the battery.

The invention claimed is:

1. A method of focusing light emitted by a light emitting diode (LED), the method including reflecting at least a portion of the light emitted by the LED, such that the reflected light radiates away from a focal point, and, after the light has been reflected, focusing at least a portion of the reflected radiated light into a beam by again reflecting the light to direct it into the beam, said reflecting and directing of said portion of the light emitted by the LED away from the focal point and into the beam being effected by means of a pair of reflecting surfaces, CHARACTERIZED in that one reflecting surface is a primary reflecting surface which is concave and in that the other reflecting surface is a secondary reflecting surface, each of the reflecting surfaces being shaped to have a focal point, and in that the reflecting surfaces are relatively aligned and spaced such that their focal points coincide to form said focal point away from which the reflected light radiates.

2. A method as claimed in claim 1, in which the reflecting of said portion of the light emitted by the LED is effected by the primary reflecting surface, and the method, simultaneously with said reflecting, including directing the light to radiate away from the focal point.

3. A method as claimed in claim 2, in which the focusing of said portion of the light after it radiates away from the focal point is by means of the secondary reflecting surface.

4. A method as claimed in claim 3, in which the directing of said portion of the light emitted by the LED to radiate away from the focal point is by passing it through the focal point, away from which it then radiates towards the secondary reflecting surface.

5. A lamp, the lamp having an operatively front end for facing in a forward direction, and the lamp including:

a framework;

a light emitting diode (LED) holder mounted on the framework for holding an LED, the LED holder being positioned relative to the framework such that an LED held thereby in use is directed for emitting light in the general forward direction on the lamp;

a primary reflector mounted on the framework and located in a path along which light is emitted by an LED held by the holder, the primary reflector having a primary reflecting surface for reflecting at least a portion of the emitted light, the primary reflector being located in front of the LED holder such that the primary reflecting surface generally faces in a rearward direction of tie lamp, for reflecting said portion of the light emitted in use by the LED in a general rearward direction of the lamp; and a secondary reflector mounted on the framework and located relative to the primary reflector such that light reflected by the primary reflector, in use, is reflected on to the secondary reflector, the secondary reflector having a secondary reflecting surface, and the secondary reflecting surface being shaped for reflecting light reflected thereonto in the forward direction of the lamp and for focusing said light into a substantially focused beam, the secondary reflector being located behind the primary reflector such that the secondary reflecting surface generally faces in the forward direction of the lamp, the secondary reflector being shaped generally to cup an LED held by the LED holder, and the primary reflector being smaller than the secondary reflector, to permit passing therearound, in the forward direction of the lamp, of the substantially focused light beam reflected by the secondary reflecting surface, the lamp defining a central optical axis extending in the fore-and-aft directions of the lamp, the LED holder being located such that an LED held thereby in use is located on the central optical axis, and the primary reflecting surface and the secondary reflecting surface being concentric about the central optical axis, CHARACTERIZED in that the primary reflector and the secondary reflector are shaped such that the primary and the secondary reflecting surfaces have generally dome-shaped profiles, each of the primary reflecting surface and the secondary reflecting surface having a focal point, and the primary reflector and the secondary reflector being relatively spaced such that the focal points of the primary reflecting surface and the secondary reflecting surface coincide, being located on the central optical axis, and in that the primary reflecting surface has a concavely domed profile, facing in the rearward direction of the lamp towards the secondary reflector and the LED holder, the primary reflector and the secondary reflector being relatively spaced such that the focal points of the primary and the secondary reflecting surfaces, which coincide, are located between the primary and the secondary reflecting surfaces and in front of an LED held by the LED holder.

6. A lamp as claimed in claim 5, in which the primary reflector is provided with a circular opening co-axial with and concentric about the central optical axis, for permitting a portion of the light emitted by an LED held by the LED holder to be emitted, without being reflected by the primary reflector, in the forward direction of the lamp, for forming part of said substantially focused beam.

7. A lamp as claimed in claim 5, in which the secondary reflector is provided with a secondary reflector opening co-axial with and concentric about the central optical axis, and in which opening the LED holder is received, such that, in use, an LED held by the holder projects through the secondary reflector opening towards the front end of the lamp.

8. A lamp as claimed in claim 7, in which the secondary reflector has at least one tertiary reflecting surface, each tertiary reflecting surface being concentric about the central optical axis and having a generally convex profile, for reflecting a portion of the light emitted by an LED held by the LED holder generally in the forward direction of the lamp for forming a peripheral light zone surrounding said substantially focused beam.

9. A lamp as claimed in claim 8, in which the secondary reflector has two tertiary reflecting surfaces, one tertiary reflecting surface framing the secondary reflector opening and the other tertiary reflecting surface framing the secondary reflecting surface, such that the secondary reflecting surface is located radially—between the two tertiary reflecting surfaces.

10. A lamp as claimed in claim 5, which includes a transparent shield located at the front end of the lamp in front of the LED holder and the secondary reflector, and through which shield light is emitted, in use, in the forward direction of the lamp, the shield having an inner face which faces the LED holder and the secondary reflector, and an outer face which faces away from the LED holder and the secondary reflector and in which the primary reflector is mounted on the shield, being located on the inner face of the shield.

11. A lamp as claimed in claim 10, in which the primary reflector is integrally formed with the shield, being located on the inner face of the Shield.

12. A lamp as claimed in claim 5, which is in the form of a headlamp for securing to the head of a user, the framework of the lamp being provided with a securing formation for securing the headlamp to the head of a user.

13. A lamp as claimed in claim 12, which is in the form of a cap lamp for securing to a safety cap for a miner, the lamp being secured to the I head of a user via the safety cap.

* * * * *